US005799429A

United States Patent [19]

Speshyock

[11] Patent Number: 5,799,429

[45] Date of Patent: Sep. 1, 1998

[54] CORNER FRAMES FOR PROTECTING AND ENHANCING FOAMBOARD AND OTHER SIMILAR MATERIALS

[76] Inventor: Michael F. Speshyock, 487 Vereda Del Ceirvo, Goleta, Calif. 93117

[21] Appl. No.: 738,812

[22] Filed: Oct. 28, 1996

Related U.S. Application Data

[63] Continuation-in-part of Ser. No. 490,097, Jun. 9, 1995, abandoned.

[51] Int. Cl.[6] ..... A47F 7/14

[52] U.S. Cl. ..... 40/778; 248/488

[58] Field of Search ..... 40/778; 248/488, 248/475.1

[56] References Cited

U.S. PATENT DOCUMENTS

| | | |
|---|---|---|
| 994,511 | 6/1911 | Gross . |
| 1,407,177 | 2/1922 | Stone . |
| 1,982,143 | 11/1934 | Schill . |
| 2,209,972 | 8/1940 | Horwitt . |
| 2,661,560 | 12/1953 | Malby . |
| 3,009,275 | 11/1961 | Rosenberg . |
| 3,256,630 | 6/1966 | Spector . |
| 4,179,089 | 12/1979 | Parr, Jr. . |
| 4,858,875 | 8/1989 | Nielsen . |
| 5,255,458 | 10/1993 | Piel . |
| 5,390,899 | 2/1995 | Hiscock . |
| 5,464,185 | 11/1995 | Hensley . |

FOREIGN PATENT DOCUMENTS

| | | |
|---|---|---|
| 564000 | 10/1923 | France . |
| 356581 | 9/1931 | United Kingdom . |
| 633443 | 7/1936 | United Kingdom . |

*Primary Examiner*—Cassandra H. Davis
*Attorney, Agent, or Firm*—Joseph R. Dwyer

[57] ABSTRACT

A corner frame having a base for engaging the back of the foamboard and a top for engaging the front of the foamboard separated by sidewalls on the base which are of a width to permit positioning the corner of the foamboard within the corner frame thus covering and protecting the corners of the foamboard. The corner frame is an assembly of two pieces—a top and a base. The top and base, being separate, are connected to one another to form a corner frame by either a slide lock feature or a snap lock feature. The corner frame may be connected to the foamboard by spikes, other gripping means or a two sided adhesive. The corner frame also may receive a cord or wire so that the corner frames may be used to hang the foamboard like a picture and/or used to straighten warped foamboards or to prevent warping of foamboards.

21 Claims, 5 Drawing Sheets

CORNER FRAMES FOR PROTECTING AND ENHANCING FOAMBOARD AND OTHER SIMILAR MATERIALS

This invention relates to an inovation in corner frames for use with foamboard and other similar materials and is a continuation-in-part of application Ser. No. 08/490,097 filed Jun. 9, 1995 by the same applicant, now abandoned. This continuation-in-part application is specifically directed to corner frames as an assembly of two pieces and to two different means for connecting the two pieces together.

Foamboard, also called art board and paper-lined foamboard, has been on the market for several years. It is used by a wide range of businesses and individuals because of its thickness (3/16" and 1/8" thickness being the most popular although the board may have a thickness of up to ½") and because of its extremely light weight. Pre-cut foamboards are available in 18"×24" up to 4'×8' sizes. Applications for the board vary from the mounting of photos and art work to signage and all matters of presentation. Another popular application is in the construction of models.

The biggest drawback in the use of this popular material is that its surface is soft and highly susceptible to denting and the unprotected corners are very easily crushed which makes the board unattractive for any presentation.

The corner frames of this invention cover and protect the corners of any foamboard presentations, large or small, and at the same time enhance the appearance of the foamboard with a decorative finished look.

It is therefore an object of this invention to provide foamboard and other similar materials with corner protection and decorative accent.

It is a still further object of this invention to provide corner frames in combination with foamboard for improving the usefullness of foamboards in presentations, art work and the like.

SUMMARY OF THE INVENTION

The invention which accomplishes the foregoing objects comprises a corner frame having a base for engaging the back of the foamboard and a top for engaging the front of the foamboard separated by sidewalls on the base which are of a width to permit positioning the corner of the foamboard within the corner frame thus covering and protecting the corners of the foamboard. The corner frame is an assembly of two pieces—a top and a base. The top and base, being separate, are connected to one another to form a corner frame by either a slide lock feature or a snap lock feature. Means are also provided for connecting the corner frame to the foamboard, such as penetrating spikes, or other gripping means, or a two-sided adhesive. The corner frame also has means for receiving cord or wire so that the corner frames may be used to hang the foamboard like a picture and/or use to straighten warped foamboards or to prevent warping of foamboards.

As will be apparent to those skilled in the art, the corner frames can additionally be utilized with other similar planar materials, such as, by way of example, cardboard, fiberboard, wood and tiles and can also be utilized with note pads of any size to keep the bottom edges from fraying, the addition of small felt or soft fabric backing to the corner frames and placing them at each corner of a large desk pad would make a finished and attractive desk assembly, corner frames may be placed at each corner of a hard bound book, such as a school book, to protect the corners from damage or applied to art work or a photograph to further protect the work or photograph from damage during shipping or storing, and a single corner frame may be placed over a group of pages within a book or magazine to act as a bookmark.

Notwithstanding the additional uses of the corner frames the following description will include only the foamboard with the corner frames to simplify the disclosure of the invention. Also, sometimes "back" and "facing" are used to describe the base and top but the latter terms will be used exclusively herein.

DETAILED DESCRIPTION OF THE INVENTION

Figure 1:
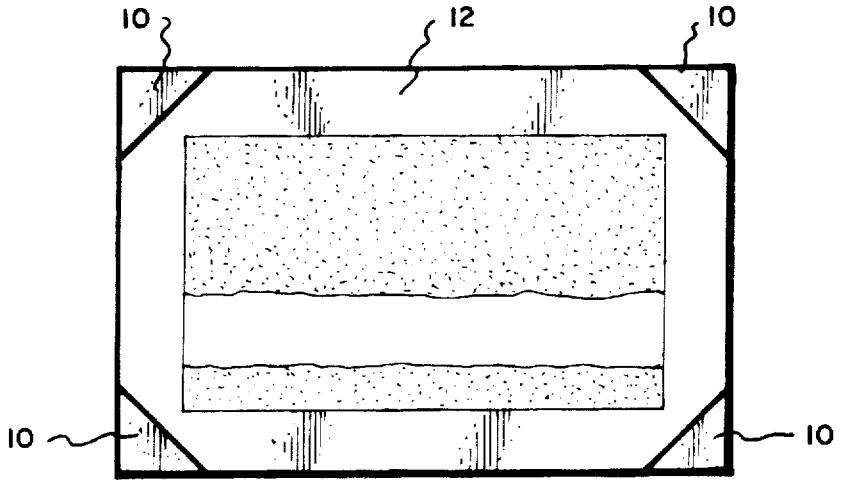
FIG. 1 is a front elevational view of corner frames on the corners of the foamboard.
Figure 2:
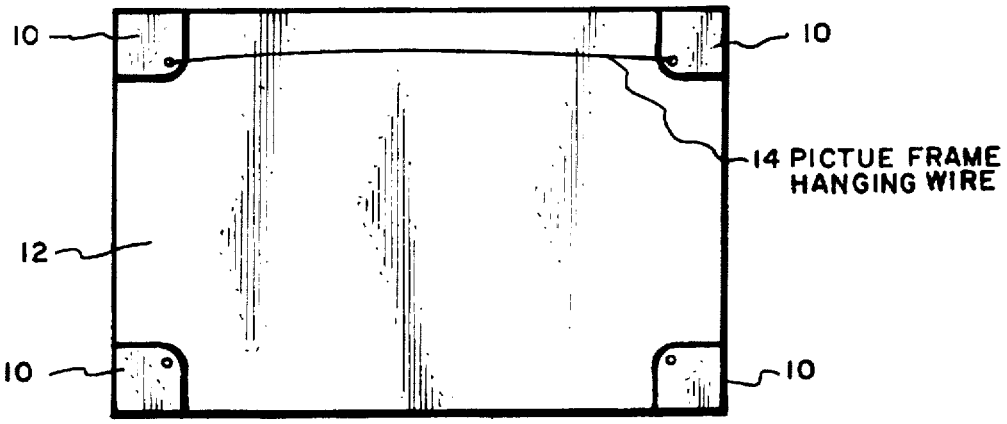
FIG. 2 is a rear elevational view of corner frames and a foamboard of FIG.1 with a picture hanging wire to mount the foamboard like a picture frame.
Figure 3:
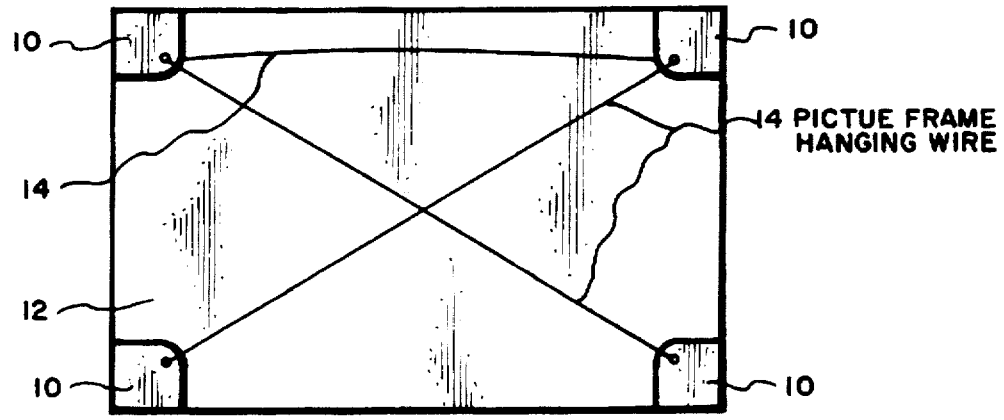
FIG. 3 is a rear elevational view of corner frames and a foamboard like FIG.2 with additional wiring to prevent warping or to cure warping of a foamboard.

FIG. 1 shows four corner frames 10 covering and protecting four corners of a foamboard 12. This Fig. also shows a typical application of a presentation on a foamboard, a print or painting. FIG. 2 shows the rear of the foamboard of FIG. 1 and additionally showing a cord or wire 14 for hanging the foamboard like a picture. FIG. 3 shows not only the cord or wire 14 for hanging the foamboard as a picture but also shows the cord or wire 14 criss-crossed and preferably stretched tightly for preventing warping of the foamboard or to cure a warped foamboard. While the criss-crossed cord or wire is shown with the picture hanging wire or cord, they need not be used together.

Figure 4:
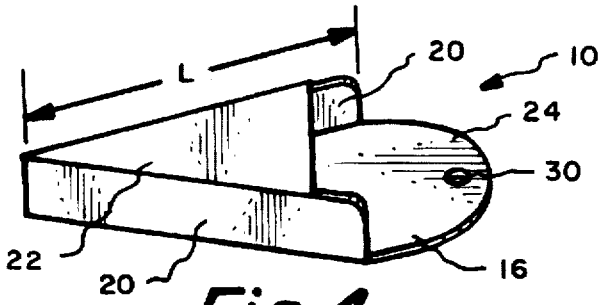
FIG. 4 is a perspective view of a corner frame showing the base, top, two sidewalls and a board engaging area of the base.
Figure 10:
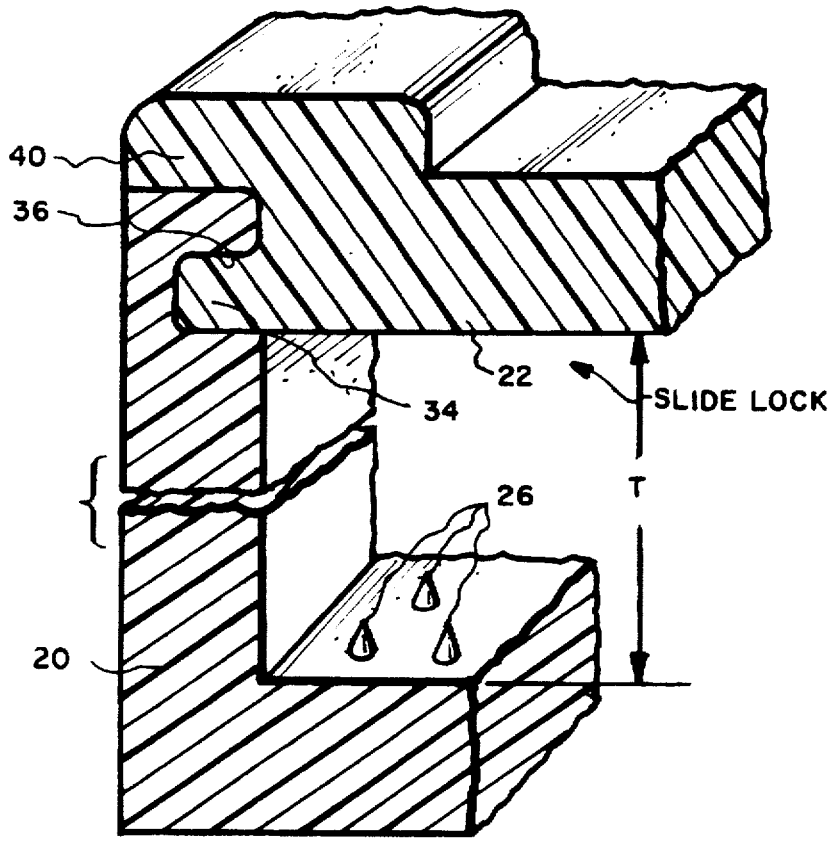
FIGS. 10 and 11 are cross-sectional views of part of a base and top to illustrate the means for slide locking the two-piece assembly together.
Figure 14:
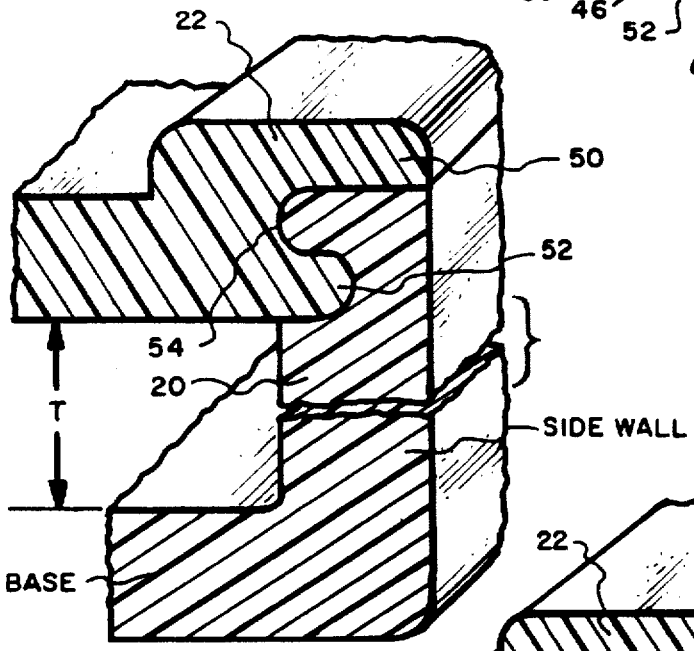
FIGS. 14 and 15 are cross-sectional views of part of a base and top to illustrate the means for snaplocking the two-piece assembly together.
Figure 15:
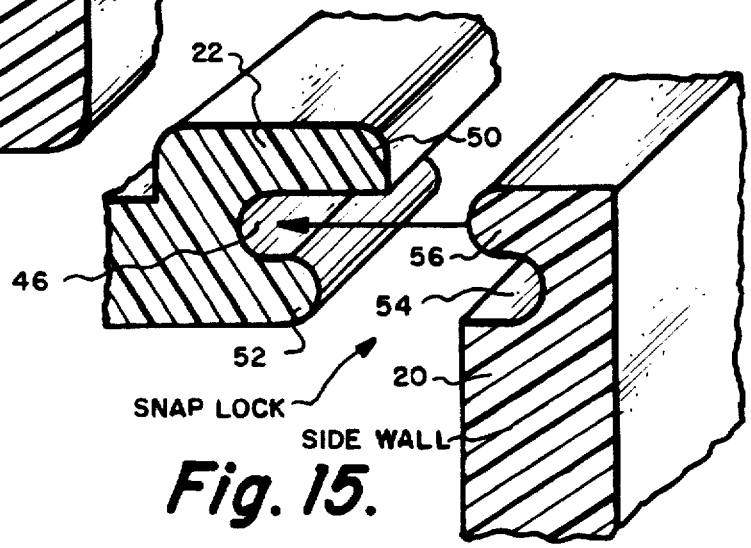

FIGS. 4, 10 and 14 show an assembled corner frame 10 of any suitable plastic with a base 16 and two sidewalls 20 at right angles to each other and a top 22 in triangular form. The length L of the sidewalls are chosen depending upon the size of the corner of the foamboard to be protected and thickness T (FIGS. 10 and 14) extends from the top of the base to the bottom of the top 22 according to the thickness of the foamboard .

The base 16 is provided with an area 24 extending beyond the edges of the sidewalls as a board engaging area. One means of attaching corner frames to the back of the foamboard is shown in the form of spikes 26 which are not shown in this figure but see FIGS. 6 and 7. These spikes are pressed into the back of the foamboard to connect the board and the corner frames together. This area also shows a hole 30 for receiving one end of a cord or wire such as 14 in FIG. 2. Each corner frame will have such a hole where two such corner frames are used for hanging the board like a picture frame. These holes may be also used to accomodate the cord or wire for curing a warped foamboard or preventing warping for the foamboard as mentioned above.

Figure 5:
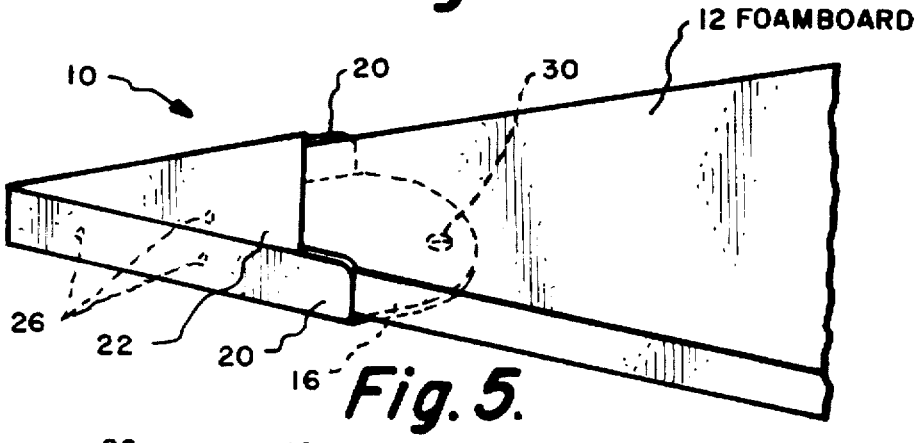
FIG. 5 is a perspective view similar to FIG.4 additionally showing a foamboard positioned within a corner frame.
Figure 6:
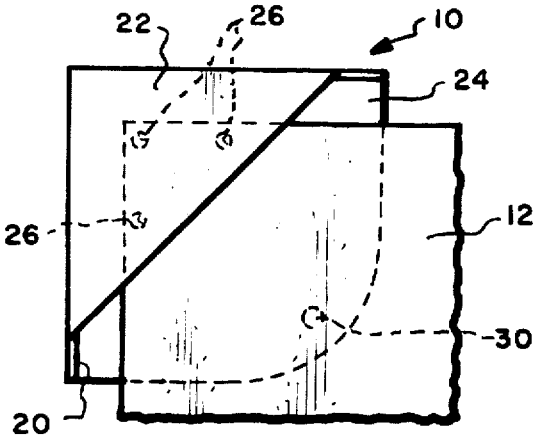
FIG. 6 is a top view of the corner frame with a foamboard partially in position.

FIG. 5 shows the foamboard 12 positioned in the corner frame 10 while FIG. 6 shows the foamboard only partially within the corner frame. Both these Figs. however, show the spikes 26 and the hole 30.

Figure 7:
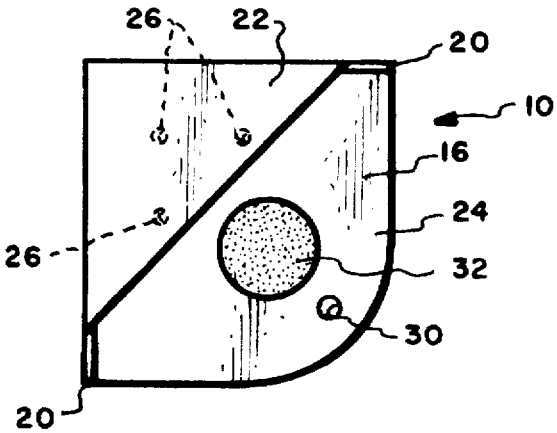
FIG. 7 is a top view of the corner frame showing a double sided tape in the board engaging area of the base.

FIG. 7 shows a corner frame 10 with a double-sided adhesive 32 in the board engaging area 24 as another means for connecting the corner frames and foamboard together. This view also shows the hole 30.

Figure 8:
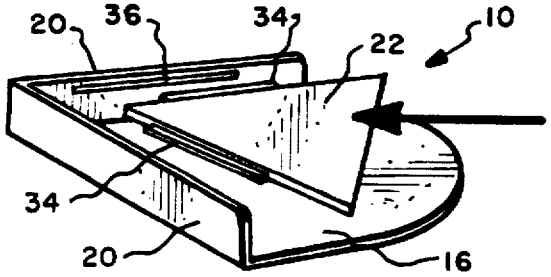
FIG. 8 is a perspective expanded view showing the corner frame as a two-piece assembly with a top separate from the base and sidewalls and further showing the slide lock feature of this invention.

FIG. 8 shows the corner frame as a two-piece assembly with top 22 separate from the base 16 and sidewalls 20. The arrow shows the manner in which the top is slide locked into the sidewalls of the base to complete the assembly. To do this, the top is provided with a pair of tongues 34 which are shorter and thinner than the top to engage a complimentary pair of grooves 36 (only 1 shown in FIG. 8) to receive the tongues and slide lock the top onto the base. The length of the grooves coincide with the length of the tongues. FIG. 8 also shows the direction of movement of the top to slide lock the top and base together. Not shown, however, is a slight downward movement of the top against the thickness of the foamboard before the tongues and grooves are mated to push the latter into the gripping means (spikes 26) to pressure lock the foamboard within the corner frame. For similar materials such as wood or tile, the double-sided adhesive 32 will be used with a slight downward movement of the top against the adhesive to slide lock the top and base together.

Figure 9:
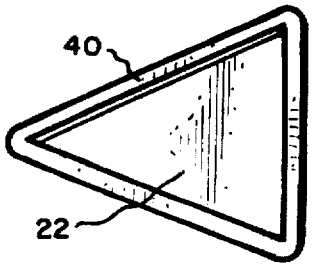
FIG. 9 is a plan view of one version of the top used herein.

FIG. 9 shows the top with a border 40 extending the periphery of the top. This border is more clearly shown in FIGS. 10 and 11 but was omitted from FIG. 8 by reason of the fact that the border extends over the tongues 34 and could not otherwise be clearly shown.

Figure 11:
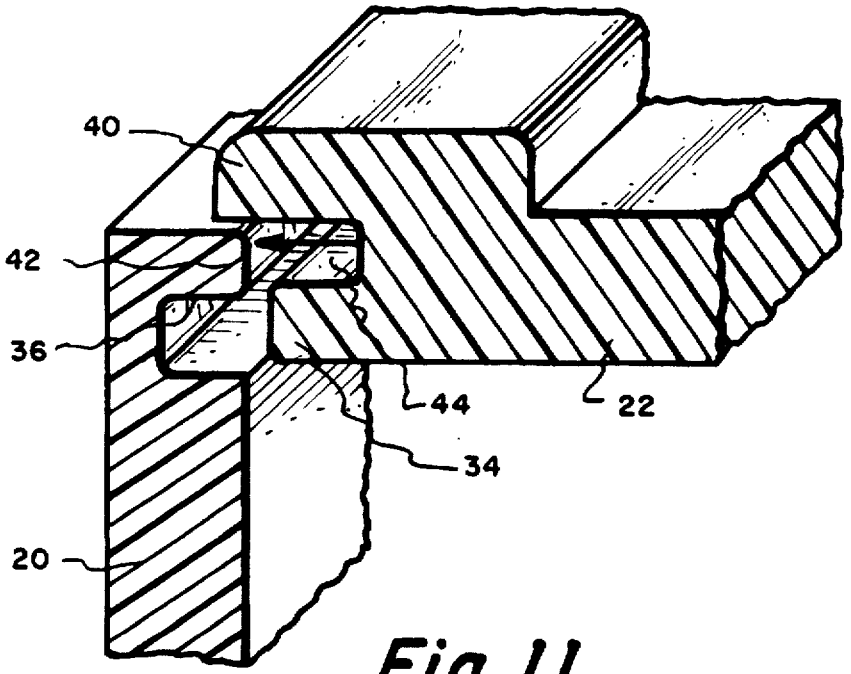

FIGS. 10 and 11 are enlarged cross-sectional views of part of the top and one sidewall to illustrate the means of accomplishing the slide lock feature. As shown, the groove 36 is shown to be relatively square in cross section and defines a boss 42 which is actually a ridge of the sidewall which engages a complimentary relatively square groove 44 in the top 22 to define the tongue 34 and the overlapping border 40 described above. FIG. 10 shows the tongue and groove connected with the border 40 overlying the top of the sidewall. This slide lock technique in part relies on the properties of the plastic material and the dimension of the tongues and grooves for such a connection.

Figure 12:
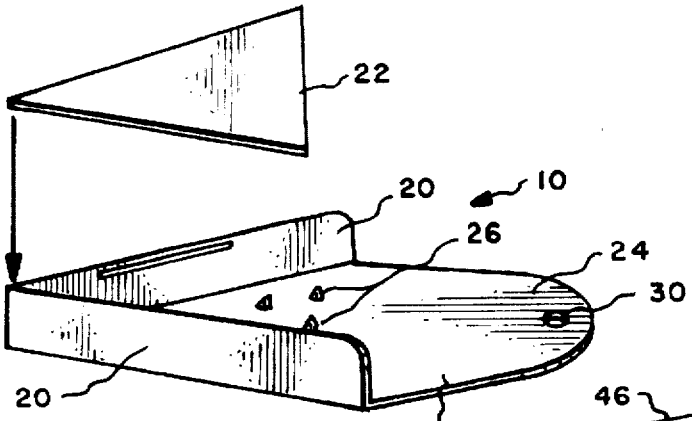
FIG. 12 is a perspective expanded view similar to FIG. 8 showing the corner frame as a two-piece assembly and showing the snaplock feature of this invention.
Figure 13:
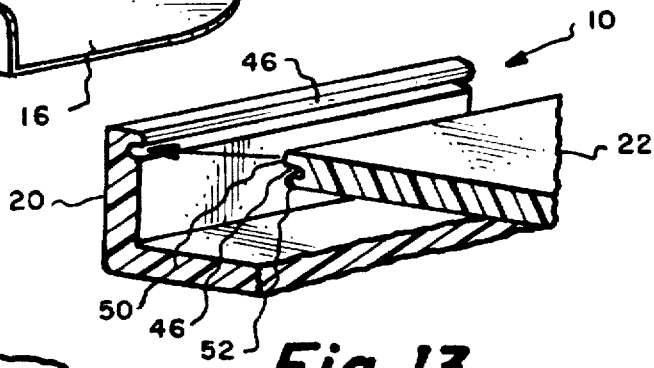
FIG. 13 is a partial perspective view of the top and base of the corner frame enlarged to show the snaplock feature of this invention.

FIGS. 12 and 13 illustrate the two-piece corner assembly somewhat similar to FIG. 8 but showing the snap lock feature of the invention. As shown, the top is provided with a narrow groove 46 which defines bosses 50 and 52. The sidewall is provided with a groove 54 which defines a boss 56. Boss 56 is received in groove 46 and boss 52 is received in groove 54 as shown in FIG. 14 when the corner frame is assembled. Note boss 50 extends over the sidewall in a manner similar to the border 40 in the prior embodiment. This snap lock feature in part relies on the properties of the plastic for such a connection.

Figure 16:
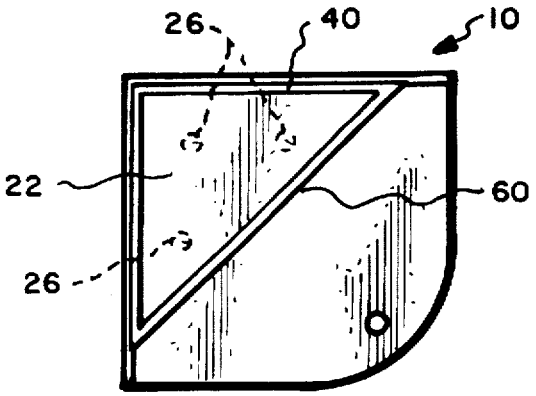
FIGS. 16–19 show variations in the top of the corner frame to enhance any presentation on the foamboard.
Figure 17:
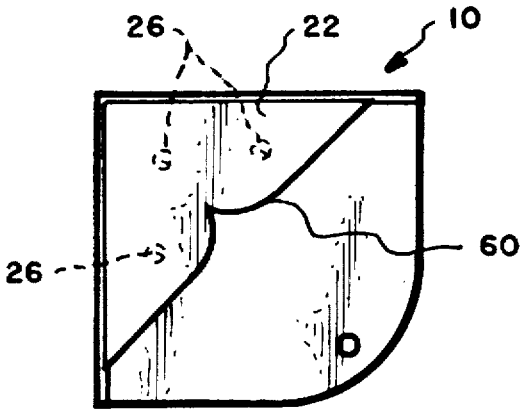
Figure 18:
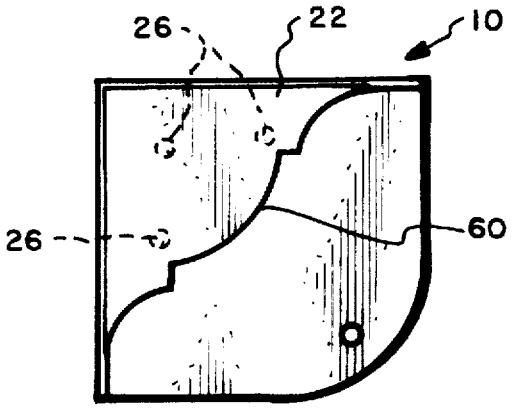
Figure 19:
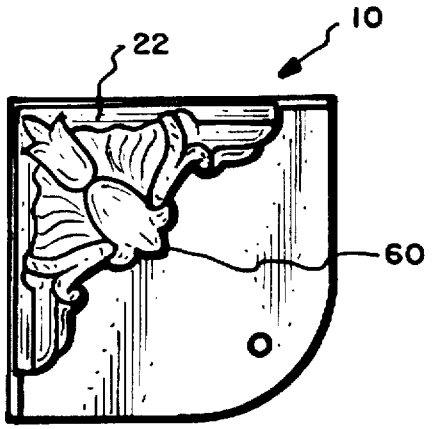
Figure 20:
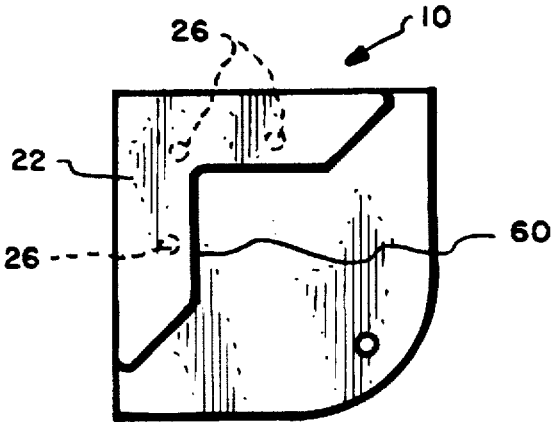
FIG. 20 is another variation of the top of the corner frame with a cut-away portion to accomodate photographs.

FIGS. 16–20 show variations in the top to be selected by the user of the corner frames. FIG. 16 shows the top as a triangle with a straight third edge 60 and also shows border 40. FIGS. 17 and 18 show variations in the top third edge 60 with FIG. 17 being considered of contemporary design and the top of FIG. 18 being considered fluted. FIG. 19 shows a filigree top to enhance the presentation on the foamboard. Such a filigree as well as a border can be on any of the tops shown. FIG. 20 shows a cut-away portion in the top to accomodate photographs, part of which would otherwise be covered by the other variations of the top. Another alternative is to place an individual company name on the top in lieu of the filigree and, any of the corner frames, top or base and sidewalls may be of any selected color or combination of colors.

I claim:

1. A corner frame for use with planar materials of a given thickness which have front and back sides and corners to protect the corners of said planar materials and to enhance the appearance of a decorative material on said planar material and provide a decorative finished look for said planar materials comprising, a base having two adjoining edges to form a corner and to coincide with the corners of said and adapted to engage the back side of said materials, a pair of sidewalls each having four side edges, with one sidewall of said pair connected to the adjoining edges of said base and a second side edge connected to one another, and two other edges of said sidewalls spaced from the sidewalls which are connected to the adjoining edges of said base thus defining the width of each said sidewall so as to coincide with the thickness of said planar materials to be used with said corner frame, a top having two edges engaging said sidewalls and adapted to engage the front side of said planar materials and wherein said top is separate from said base and sidewalls and having means for slidelocking said top with said sidewalls so that a corner of said planar materials is receivable between said top and said base.

2. The corner frame as claimed in claim 1 wherein said means for slidelocking said top with said sidewalls comprises tongue and groove means.

3. The corner frame as claimed in claim 1 wherein said corner frame includes a plurality of gripping means to be pressed into the back side of said planar materials to fix said planar materials in said corner frame.

4. The corner frame as claimed in claim 1 wherein said corner frame includes double sided adhesive so as to connect the back side of said planar materials to said corner frame.

5. The corner frame as claimed in claim 1 wherein said corner frame further includes a hole for receiving cord or wire used for hanging said planar materials and for receiving a cord or wire used for preventing and curing warping of planar materials.

6. The corner frame as claimed in claim 1 wherein said top has a third edge which is fluted.

7. The corner frame as claimed in claim 1 wherein said top has a third edge which is straight such that said top forms a triangle.

8. The corner frame as claimed in claim 1 wherein said top has a third edge which is curved to form a peak centrally of the third edge thus defining a contemporary design.

9. The corner frame as claimed in claim 1 wherein said top is provided with classic filigree.

10. The corner frame as claimed in claim 1 wherein a third edge on said top is cut-away to accomodate photographs.

11. In combination with a four-cornered foamboard with a front and back, corner frames for each of the four-cornered foamboard to protect the four corners of said foamboard and to enhance the appearance of a decorative material on said foamboard and provide a decorative finished look for said foamboard, each corner frame comprising, a base having two adjoining edges to form a corner and coincide with the corners of said foamboard and for engaging the back of said foamboard, a pair of sidewalls each having four side edges, with one side edge of each sidewall of said pair connected to adjoining edges of the base and a second side edge of each of said four side edges connected to one another where said adjoining edges are connected together, two side edges of said four side edges of said sidewalls spaced from said sidewall which is connected to said adjoining edge and defining the width of each said sidewall and coinciding with the thickness of said foamboard, a top having two edges engaging said two side edges which are spaced from the sidewall and engaging the front of said foamboard and wherein said top is separate from said base and sidewalls and having means for slidelocking said top with said sidewalls so that each corner of said foamboard is received between said top and said base, said base having means defining an area which extends beyond the sidewalls, and means cooperable with said area for connecting said corner frame to each of the corners of said foamboard.

12. The combination as claimed in claim 11 wherein said means for slidelocking said top with said sidewalls comprises tongue and groove means.

13. The combination as claimed in claim 11 wherein said corner frame includes a plurality of penetrating spikes to be pressed into the back of said foamboard to fix said foamboard in each corner frame.

14. The combination as claimed in claim 11 wherein said corner frame includes double-sided adhesive so as to connect the back of said foamboard to each corner frame.

15. The combination as claimed in claim 11 wherein said engaging area further includes a hole for receiving cord or wire through two corner frames for hanging said foamboard.

16. The combination as claimed in claim 11 wherein said top has a third edge which is fluted.

17. The combination as claimed in claim 11 wherein said top has a third edge which is straight such that said top forms a triangle.

18. The combination as claimed in claim 11 wherein said top has a third edge which is curved to form a peak centrally of the third edge thus defining a contemporary design.

19. The combination as claimed in claim 11 wherein said top has a third edge which is cut-away to accomodate photographs.

20. The combination as claimed in claim 11 wherein said top is provided with classic filigree.

21. A corner frame comprising a two-piece assembly for use with planar materials of a given thickness which have front and back sides and corners to protect the corners of said planar materials and to enhance the appearance of a decorative materials on said planar materials and provide a decorative finished look for said planar materials comprising, one piece comprising a base having two adjoining edges to form a corner and to coincide with the corners of said materials and adapted to engage the back side of said materials, a pair of sidewalls each having four side edges, with one sidewall of said pair connected to the adjoining edges of said base and a second side edge connected to one another, the other edges of said sidewalls defining the width of each said sidewall so as to coincide with the thickness of said planar materials to be used with said corner frame, a second piece comprising a top having two edges engaging said sidewalls and adapted to engage the front side of said planar materials, and means for slidelocking said top to said base, said means for slidelocking comprising tongue and groove means defined by a pair of tongues extending from two edges of said top and a pair of grooves in said two adjoining edges of said base, each of said tongues being thinner and shorter than the width and length of the two edges and each said grooves being complimentary to said tongues in width, length and depth so as to receive said tongues.

* * * * *